United States Patent [19]

Phelan

[11] 4,175,526

[45] Nov. 27, 1979

[54] APPARATUS FOR VENTING FUEL VAPORS FROM A CARBURETOR FUEL BOWL

[75] Inventor: Michael B. Phelan, Florissant, Mo.

[73] Assignee: ACF Industries, Incorporated, New York, N.Y.

[21] Appl. No.: 848,986

[22] Filed: Nov. 7, 1977

[51] Int. Cl.[2] ..... F02M 59/42

[52] U.S. Cl. ..... 123/136; 261/72 R

[58] Field of Search ..... 123/136; 261/72 R

[56] References Cited

U.S. PATENT DOCUMENTS

| | | | |
|---|---|---|---|
| 2,986,133 | 5/1961 | Mattson | 123/136 |
| 3,001,519 | 9/1961 | Dietrich et al. | 261/72 R |
| 3,460,522 | 8/1969 | Kittler et al. | 123/136 |
| 3,545,418 | 12/1970 | Ballou | 123/136 |
| 3,548,797 | 12/1970 | Hagibara | 261/72 R |
| 3,759,234 | 9/1973 | Bucklon et al. | 123/136 |
| 4,013,054 | 3/1977 | Balsley et al. | 123/136 |
| 4,085,721 | 4/1978 | Vardi et al. | 123/136 |

OTHER PUBLICATIONS

"Evaporative Control Device," Esso Research & Engr. Co., paper on Hot Soak.

*Primary Examiner*—Charles J. Myhre
*Assistant Examiner*—R. A. Nelli
*Attorney, Agent, or Firm*—Edward H. Casey

[57] ABSTRACT

Apparatus for venting fuel vapors present in the fuel bowl of a carburetor for an internal combustion engine, the carburetor having a passage through which air is drawn into the engine and a throttle valve positioned in the passage and movable between an open and a closed position to control the flow of air therethrough. The apparatus comprises an evacuable chamber and a first fluid flow path extends between the air passage and the chamber and a second fluid flow path extends between the chamber and the fuel bowl. The first fluid flow path is unblocked and the second fluid flow path is blocked when the engine is running whereby the chamber is evacuated and a vacuum is created therein and the first fluid flow path is blocked and the second fluid flow path is unblocked when the engine is not running whereby fuel vapors in the fuel bowl are drawn off to the chamber by the vacuum created therein thereby venting the fuel bowl.

9 Claims, 4 Drawing Figures

APPARATUS FOR VENTING FUEL VAPORS FROM A CARBURETOR FUEL BOWL

BACKGROUND OF THE INVENTION

This invention relates to carburetor and more particularly to apparatus for venting fuel vapors from a fuel bowl of a carburetor.

Carburetor assemblies typically include a fuel bowl which holds fuel, e.g. gasoline, that is supplied to the engine on which the carburetor is installed. When the engine is shut off after running for some time, a "hot soak" condition exists in which heat from the engine elevates the temperature in the fuel bowl causing the gasoline to give off vapors. As the engine gradually cools off, the fuel bowl temperature also decreases and increasingly smaller amounts of vapors are produced. If the fuel bowl is vented, the vapors produced boil out of the fuel bowl through the vent and may, for example, accumulate in the air space adjacent an air induction passage of the carburetor. Over time, the vapors saturate this air space and may gravitate into the intake manifold of the engine displacing the air in this region. Consequently, when the engine is next started, an overly rich air-fuel mixture is supplied to it making the engine difficult to start and increasing the amount of pollutants emitted from the engine during starting.

SUMMARY OF THE INVENTION

Among the several objects of the present invention may be noted the provision of apparatus for venting the fuel bow of a carburetor for an internal combustion engine; the provision of such apparatus for venting fuel vapors from the carburetor fuel bowl during a "hot soak" condition of the engine, i.e., when the engine is shut off after running; the provision of such apparatus for venting fuel vapors until the engine has cooled to a temperature where almost no fuel vapors are produced; the provision of such apparatus for facilitating engine starting and reducing emissions produced during starting; the provision of such apparatus for absorbing vented fuel vapors; the provision of such apparatus in which vented fuel vapors are supplied to the engine when it is running; the provision of such apparatus in which vented fuel vapors condense and are returned to a fuel tank which supplies fuel to the fuel bowl and the provision of such apparatus which eliminates the need for inside vent controls and other vapor seals.

Briefly, apparatus of the present invention is for venting fuel vapors present in the fuel bowl of a carburetor for an internal combustion engine, the carburetor having a passage through which air is drawn into the engine and a throttle valve positioned in the passage and movable between an open and a closed position to control the flow of air therethrough. The apparatus comprises an evacuable chamber and a first fluid flow path extends between the air passage and the chamber and a second fluid flow path extends between the chamber and the fuel bowl. Control means responsive to the operation of the engine unblocks the first fluid flow path and blocks the second fluid flow path when the engine is running whereby the chamber is evacuated and a vacuum is created therein and blocks the first fluid flow path and unblocks the second fluid flow path when the engine is not running whereby fuel vapors in the fuel bowl are drawn off to the chamber by the vacuum created therein thereby venting the fuel bowl. Other objects and features will be in part apparent and in part pointed out hereinafter.

DESCRIPTION OF PREFERRED EMBODIMENTS

Figure 1:
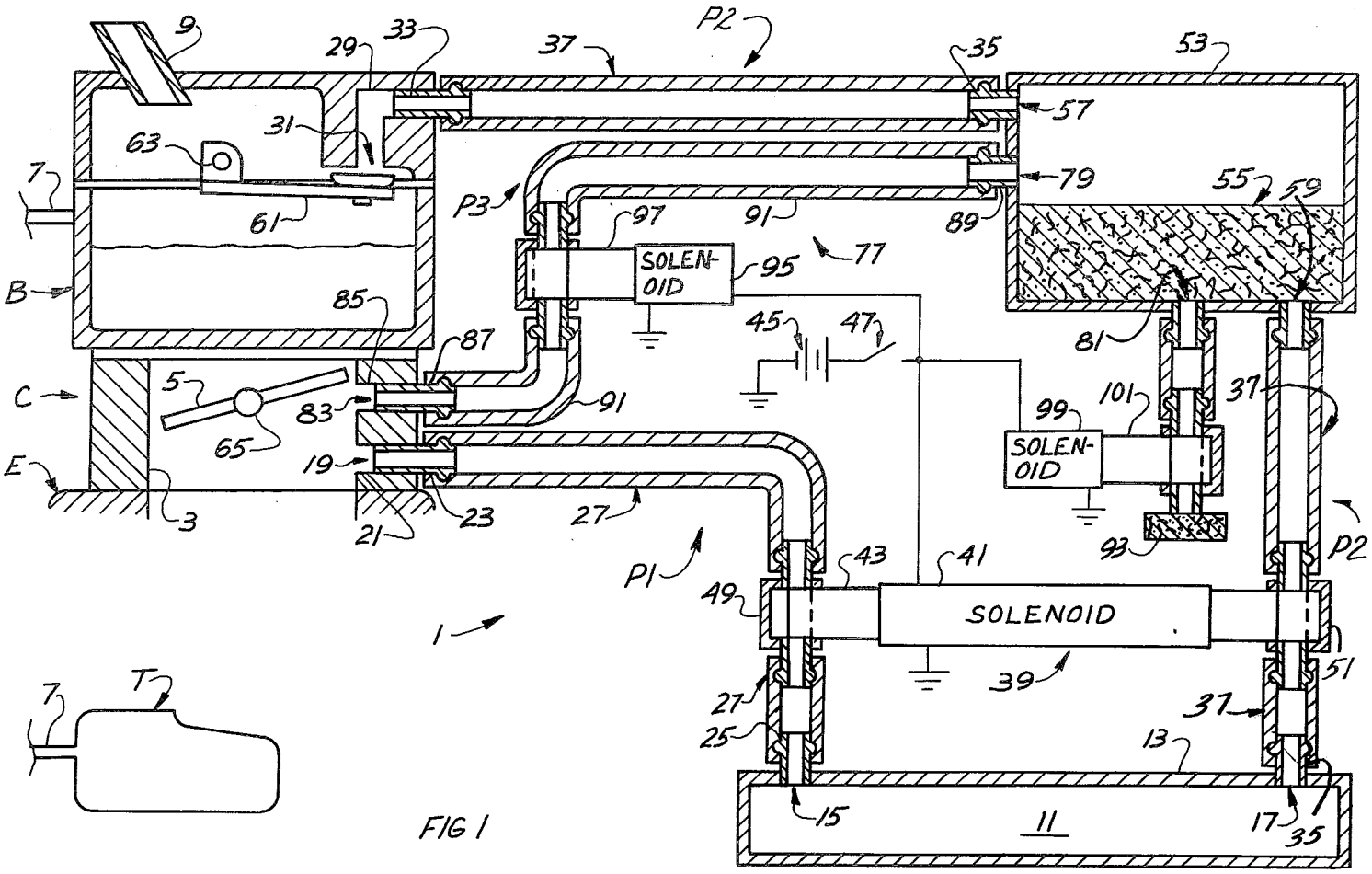
FIG. 1 is a semi-diagrammatic view of a first embodiment of apparatus of the present invention for venting vapors from a fuel bowl of a carburetor.

Referring now to the drawings, apparatus of the present invention for venting fuel vapors present in a fuel bowl B of a carburetor C for an internal combustion engine E is indicated generally at 1. The carburetor has an induction passage 3 through which air is drawn into the engine and a throttle valve 5 is positioned in the passage and is movable between an open and a closed position to control the flow of air through the induction passage. Fuel from a fuel tank T is delivered to fuel bowl B through a fuel line 7. Fuel from fuel bowl B is delivered to induction passage 3 via one or more fuel circuits (not shown). The design and construction of fuel systems for delivering fuel from tank T to fuel bowl B and of fuel circuits such as high speed and idle speed fuel circuits for delivering fuel from the fuel bowl to the induction passage are well known in the art. Fuel drawn to induction passage 3 is mixed with air passing through the passage to form an air-fuel mixture combusted in engine E.

As shown in the drawings, carburetor C is mounted atop the engine. High temperatures are produced in the engine when it is running and when the engine is shut off, a "hot soak" condition is created in which the carburetor C, and more specifically, fuel bowl B of the carburetor, is subjected to the heat produced by the engine. Because the fuel delivered to the fuel bowl and used in the engine, e.g. gasoline, is volatile, the elevated temperatures occurring during a "hot soak" cause some of the fuel to boil off, i.e. vaporize. A bowl vent 9 is provided in the fuel bowl cover and the vapors produced flow out of the fuel bowl through the vent. These vapors tend to gravitate down into the intake manifold of the engine. This causes hard starting and excessive emissions when the engine is next started.

The apparatus of the present invention comprises an evacuable chamber or reservoir 11 which may be formed as part of the carburetor body or which may be a separate unit. If separate from the carburetor body, chamber 11 is formed by a hollow shell 13 of air-tight sheet metal construction. Two openings, 15 and 17 respectively, are formed in shell 13.

A first fluid flow path, generally designated P1, extends between induction passage 3 and the chamber. An outlet 19 of the flow path opens into the air induction passage at a point below the position of throttle valve 5 and opening 15 in shell 13 forms the inlet of the flow path. If, as shown in FIG. 1, chamber 11 is separate from the carburetor, a passage 21 is formed in the carburetor body, one end of the passage forming outlet 19 of flow path P1. A nipple 23 is inserted into the other end of this passage. A nipple 25 is fitted into opening 15 in shell 13 and the ends of a flexible tubing, generally indicated 27, are fitted onto the respective nipples.

A second fluid flow path, generally designated P2, extends between chamber 11 and fuel bowl B. For this purpose, fuel bowl B has an outlet passage 29 one end 31 of which forms the inlet to path P2. A nipple 33 is inserted into the other end of passage 29 and a nipple 35 is fitted into opening 17 of shell 13. Opening 17 forms the outlet of path P2. The ends of a flexible tubing, generally indicated 37, are attached to the respective nipples.

A control means, generally designated 39, is responsive to the operation of engine E and comprises a solenoid 41 having an armature 43. The armature is movable between flow paths P1 and P2. The coil of the solenoid is connected in a circuit including a battery 45 and a switch 47, switch 47 being the ignition switch for turning on and shutting off the engine. The battery and the switch comprise means for energizing and de-energizing the solenoid. When ignition switch 47 is closed, to start the engine and keep it running, solenoid 41 is energized and armature 43 is moved to a position (the dashed line position shown in FIG. 1) to block flow path P2 and unblock flow path P1. When the switch is open, as when engine E is shut off and not running, the armature is moved to a position (the solid line position shown in FIG. 1) to block flow path P1 and unblock flow path P2.

The blocking of the respective flow paths may be accomplished in a number of ways. For example, the ends of the armature may bear against respective tubing 27 and 37 to pinch off the tubing. Or, as shown in FIG. 1, cups 49 and 51 may be respectively interposed in fluid flow paths P1 and P2. The respective cups may have an interior shape conforming to that of armature 43 so when the armature moves to a blocking position it creates a fluid tight obstruction in the flow path. When the armature moves to an unblocking position, the end of the armature is clear of the flow path across the respective cup.

A canister, generally designated 53, is positioned in fluid flow path P2 and is interposed between the inlet to the fluid flow path and the point of path blockage and unblockage. Canister 51 contains an adsorbent material 55 such as activated charcoal or other similar carbon material, which as well known in the art, serves to trap fuel vapors such as gasoline vapors. The canister has an inlet 57 in communication with outlet passage 29 of fuel bowl B and an outlet 59, which is a restricted outlet, in communication with inlet 17 of chamber 11.

Figures 2, 3, 4:
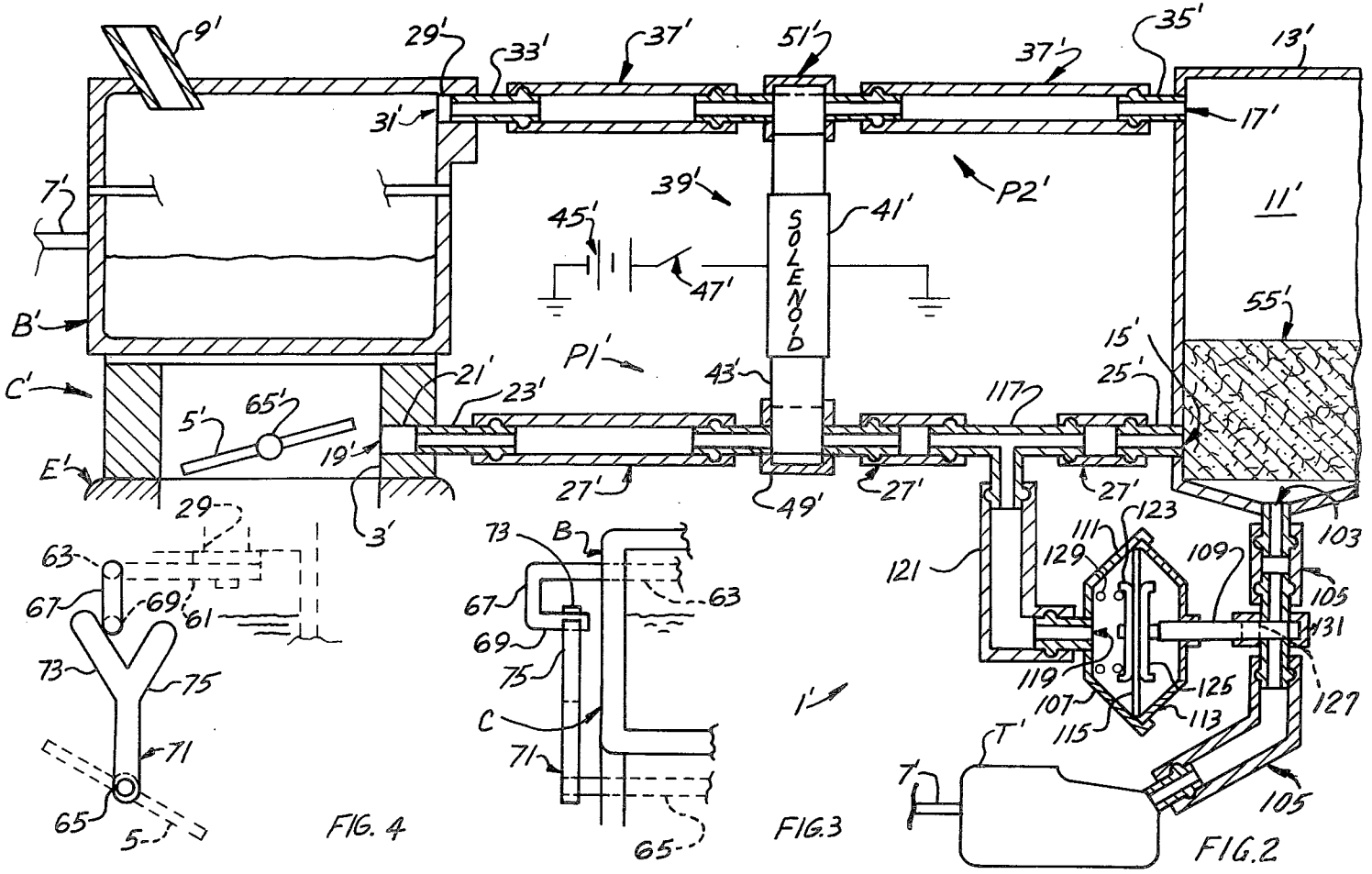
FIG. 2 is a semi-diagrammatic view of a second embodiment of apparatus of the present invention for venting vapors from a fuel bowl of a carburetor.
FIGS. 3 and 4 are respective side elevational and front plan views of a lever mechanism used to open and close a valve in the fuel bowl of a carburetor. Corresponding reference characters indicate corresponding parts throughout the several views of the drawings.

A valve 61 blocks the inlet to passage 29 when engine E is running. The valve is carried by a shaft 63 whose rotational movement is controlled by the rotational movement of a shaft 65 on which throttle valve 5 is mounted. As shown in FIG. 3, the outer end of shaft 63, projects beyond the outer wall of fuel bowl b and has a vertically depending arm 67 whose lower end terminates in an inwardly projecting finger 69. A Y-shaped lever 71 has its lower end attached to shaft 65. A lever arm 73 bears against finger 69 when throttle valve 5 is open to exert a counterclockwise rotational force on shaft 63 and seat valve 61 against the inlet to passage 29 to close the passage. When throttle valve 5 closes, lever 71 rotates counterclockwise and a lever arm 75 bears against finger 69 to exert a clockwise rotational force on shaft 63 to move valve 61 away from the inlet to passage 29 and open the passage.

In operation, when switch 47 is closed and engine E is running, solenoid 41 is energized and armature 43 is moved to a position blocking flow path P2 and unblocking flow path P1. As air is drawn into engine E through induction passage 3, a vacuum is created in chamber 11 and any air in the chamber is withdrawn from the chamber through fluid flow path P1 into the induction passage and the engine. When switch 47 opens as the engine is shut off, solenoid 41 is de-energized and armature 43 moves to a position blocking path P1 and unblocking path P2. Since throttle valve 5 is closed when the engine is shut off, valve 61 opens and the vacuum pressure created in chamber 11 is exerted on the interior of fuel bowl B. As gasoline vapors are created due to the "hot soak" condition now existing, they are drawn off through fluid flow path P2 to canister 53 where they are adsorbed by adsorbent material 55. Vent 9 serves as a source of air for this venting operation and the restricted opening 59 in canister 53 controls the rate at which vapors in the fuel bowl are drawn off and the amount of time it takes to exhaust the vacuum in chamber 11. The size of chamber 11 and of restricted opening 59 are such that by the time the vacuum created in the chamber is exhausted, the engine has cooled sufficiently so the fuel bowl temperature has decreased to a point where little or no fuel vapors are generated. When switch 47 is again closed and engine E is restarted, fluid flow path P2 is again blocked. Further, opening of throttle valve 5 causes valve 61 to close, so the fuel vapors remain trapped in canister 53. As a result of the venting, few, if any, fuel vapors escape into the air space above the carburetor and the engine starting time is reduced and less emissions are produced during starting. Further, the need for an inside bowl vent control and vapor seals is eliminated.

Means, generally designated 77, are provided for purging canister 53 and supplying the fuel vapors adsorbed by charcoal material 55 to engine E. Canister 53 has an opening 79 in its upper face and an opening 81 in its lower face. A third fluid flow path, generally indicated P3, extends between opening 79 and induction passage 3. An outlet 83 of the flow path opens into the induction passage below the location of throttle valve 5. As shown in FIG. 1, a passage 85 is formed in the carburetor body, one end of the passage forming outlet 83. A nipple 87 is inserted into the other end of the passage and a nipple 89 is fitted into opening 79. The ends of a tube, generally designated 91, are fitted onto the respective nipples. Opening 81 forms an air inlet communicating between the atmosphere and the adsorbent material. An air filter 93 is interposed between the atmosphere and inlet 81 to filter outside air drawn into the canister.

A solenoid 95 has an armature 97 movable between a position blocking fluid flow path P3, when the solenoid is de-energized and a position unblocking the flow path when the solenoid is energized. Similarly, a solenoid 99 has an armature 101 movable between a position blocking air inlet 81 when the solenoid is de-energized and unblocking the air inlet when the solenoid is energized. Both solenoids are energized by the closure of switch 47 and de-energized by opening of the switch.

When switch 47 is closed and the engine is running, air is drawn through inlet 81, canister 53, and flow path P3 to induction passage 3. The flow of air through the canister draws off the vapors previously adsorbed by the charcoal material and carries these vapors to the induction passage. When switch 47 opens and the engine is shut off, the solenoids are de-energized and air inlet 81 and fluid flow path P3 are blocked. Thus, vapors vented from the fuel bowl, as previously described, are contained in canister 53 and the canister is purged only when the engine is running.

Referring now to FIG. 2, a second embodiment of the apparatus of the present invention includes a chamber 11' defined by a hollow shell 13'. The chamber has a restricted opening or inlet 17' and an outlet 15'. A first fluid flow path P1' extends being an opening 19' in air induction passage 3' of carburetor C' and chamber 11' and a second fluid flow path P2' extends between an outlet passage 29' in fuel bowl B' of the carburetor and the chamber. A solenoid 41' has a movable armature 43' for blocking path P2' and unblocking path P1' when a switch 47' is closed and engine E' is running and for unblocking path P2' and blocking path P1' when switch 47' is open and the engine is off. The lower portion of chamber 11' is filled with an adsorbent material 55' which may be activated charcoal or another suitable material.

In operation, chamber 11' is evacuated when the engine is running and path P2' is blocked and path P1' is unblocked. When the engine is shut off and a "hot soak" condition exists, path P2' is unblocked and path P1' is blocked. The vapors produced in fuel bowl B' are drawn off to the chamber by the vacuum created therein. The vacuum is gradually exhausted, and by the time it is gone, the engine has sufficiently cooled so little or no additional fuel vapors are produced. Much of the fuel vapor drawn into the chamber gravitates toward the bottom of the chamber and is adsorbed by the charcoal. When the engine is next started and path P1' is again unblocked and path P2' is again blocked, chamber 11' is again evacuated. The air in chamber 11' is drawn through the adsorbent material 55' and path P1' into induction passage 3'. This action serves to purge the adsorbent material of any fuel vapors trapped therein.

Fuel vapors trapped in the adsorbent material will, over time, condense and the liquid fuel collects at the bottom of chamber 11'. An opening 103 is formed in the bottom of the chamber and a return line 105 extends between this opening and a fuel tank T'. A vacuum actuated solenoid 107 has a movable armature 109 for blocking and unblocking the fuel return line to the tank. The solenoid comprises thin-walled cup-shaped body portions 111 and 113 and the outer margin of a flexible diaphragm 115 is clamped between the two body portions. A tee 117 is inserted in flow path P1' between outlet 15' of chamber 11' and the location in the flow path where armature 43' of solenoid 41' blocks and unblocks the flow path. Body portion 111 of solenoid 107 has an opening 119 and a tube 121 connects this opening to one leg of the tee. Diaphragm 115 is sandwiched between a pair of backing plates 123 and 125 respectively. One end of armature 109 is attached to the diaphragm in any conventional manner for movement with the diaphragm when it flexes. The other end of the armature has a transverse opening 127 which when aligned with opening 103 in chamber 11' and with return line 105 permits condensed fuel in the bottom of the chamber to drain back into tank T'. A spring 129 seats against backing plate 123 and urges diaphragm 115 in the direction to move armature 109 into an unblocking position for draining condensed fuel to the tank. A cup 131 similar in construction to cups 49' and 51' previously described, is positioned in the return line and armature 109 is movable back and forth in this cup.

When switch 47' is closed and path P1' is unblocked, a vacuum is created in body portion 111 of solenoid 107 in the same manner as a vacuum is created in chamber 11'. The vacuum causes diaphragm 115 to move leftward, as shown in FIG. 2, against the force of spring 129 and armature 109 moves to a position blocking return line 105. This vacuum persists for some time after switch 47' opens, during which time fuel vapors in blow B' are vented to chamber 11' where they are adsorbed by charcoal material 55' with some of the vapors condensing and collecting in the bottom of the chamber. As the vacuum is exhausted, the force exerted by spring 129 moves armature 109 to the right until opening 127 unblocks the path between opening 103 in chamber 11' and fuel return line 105. When this occurs, condensed fuel in the chamber flows out of opening 103 and through line 105 back to tank T'.

In view of the above, it will be seen that the several objects of the invention are achieved and other advantageous results attained.

As various changes could be made in the above construction without departing from the scope of the invention, it is intended that all matter contained in the above description or shown in the accompanying drawings shall be interpreted as illustrative and not in a limiting sense.

I claim:

1. Apparatus for venting fuel vapors present in the fuel bowl of a carburetor for an internal combustion engine, said carburetor having a passage through which air is drawn into the engine and a throttle valve positioned in the passage and movable between an open and a closed position to control the flow of air therethrough, the apparatus comprising:

an evacuable chamber;

a first fluid flow path extending between said air passage and said chamber and a second fluid flow path extending between said chamber and said fuel bowl, said second fluid flow path having means positioned therein for adsorbing fuel vapors drawn from said fuel bowl; and control means responsive to the operation of said engine for unblocking said first fluid flow path and blocking said second fluid flow path when said engine is running whereby said chamber is evacuated and a vacuum is created therein and for blocking said first fluid flow path and unblocking said second fluid flow path when said engine is not running whereby fuel vapors in said fuel bowl are drawn off to the chamber by the vacuum created therein thereby venting the fuel bowl.

2. The apparaus as set forth in claim 1 wherein said control means comprises a solenoid having an armature movable between said first and second flow paths to block and unblock the respective flow paths.

3. The apparatus as set forth in claim 2 wherein said control means further includes means for energizing said solenoid when said engine is running to move said armature to a position blocking said second fluid flow path and unblocking said first fluid flow path and for deenergizing said solenoid when said engine is not running to move said armature to a position blocking said first fluid flow path and unblocking said second fluid flow path.

4. The apparatus as set forth in claim 1 wherein the apparatus further includes means for purging said vapor absorbing means.

5. The apparatus as set forth in claim 4 wherein said purging means comprises a third fluid flow path extending from said vapor adsorbing means to said air passage and an air inlet in communication with the atmosphere and said vapor adsorbing means.

6. The apparatus as set forth in claim 5 wherein said control means further includes means for blocking said third fluid flow path and said air inlet when said engine is not running and for unblocking said third fluid flow path and said air inlet when said engine is running whereby when said engine is running, atmospheric air is drawn into the air passage through said inlet and said third fluid flow path, the air passing through said vapor adsorbing means and removing the fuel vapors adsorbed thereby.

7. The apparatus as set forth in claim 2 further including means for returning fuel condensed from the fuel vapors adsorbed by the vapor adsorbing means to a fuel tank.

8. The apparatus as set forth in claim 7 wherein said fuel returning means comprises a return flow path extending between said vapor adsorbing means and said fuel tank and means responsive to the vacuum created in said chamber for blocking said return flow path until the vaccum is substantially exhausted.

9. The apparatus as set forth in claim 8 wherein said vacuum responsive means comprises a vacuum actuated solenoid having an armature movable to a position blocking said return flow path when a vacuum is created in said chamber and to a position unblocking said return flow path when said vacuum is substantially exhausted.

* * * * *